United States Patent [19]

Menaged

[11] Patent Number: 5,035,393

[45] Date of Patent: Jul. 30, 1991

[54] PORTABLE, COLLAPSIBLE READING STAND WITH ADJUSTMENT MEANS

[76] Inventor: David L. Menaged, 12260 SW. 40th St., Miami, Fla. 33175

[21] Appl. No.: 492,881

[22] Filed: Mar. 12, 1990

[51] Int. Cl.[5] ..... A47G 1/24

[52] U.S. Cl. ..... 248/456; 248/460

[58] Field of Search ..... 248/457, 454, 455, 456, 248/457, 460, 463, 465

[56] References Cited

U.S. PATENT DOCUMENTS

| | | | |
|---|---|---|---|
| 706,228 | 8/1902 | Fleming | 248/456 |
| 756,486 | 4/1904 | Fleming | 248/456 |
| 1,203,659 | 11/1916 | Smith | 248/456 |
| 3,381,928 | 5/1968 | White | 248/455 |
| 3,562,796 | 2/1971 | Jacobson | 248/456 |
| 3,991,967 | 11/1976 | Sack | 248/453 |
| 4,044,980 | 8/1977 | Cummins | 248/460 |
| 4,460,146 | 7/1984 | Raggiott | 248/460 |
| 4,555,128 | 11/1985 | White | 248/456 |
| 4,848,243 | 7/1989 | Giordano | 248/455 |

*Primary Examiner*—Robert L. Wolfe

*Attorney, Agent, or Firm*—Malloy, Downey & Malloy

[57] ABSTRACT

A reading stand designed to be collapsible and therefore portable and selectively unfolded into an operative position on a supporting surface for the support and retention of a book or like object to be read in an optimum position for viewing. A copy holder for supporting the book or like object may be selectively adjustable as to its angular orientation and/or height relative to the supporting surface on which the reading stand is positioned.

9 Claims, 2 Drawing Sheets

PORTABLE, COLLAPSIBLE READING STAND WITH ADJUSTMENT MEANS

BACKGROUND OF THE INVENTION

1. Field of the Invention

This invention relates to a reading stand which may be adjusted as to its angular orientation relative to a supporting surface as well as its height and further may be collapsible so as to be easily carried with the user from one location to another.

1. Description of the Prior Art

Reading stand structures are prevalent both in the prior patented art and in actual use. These reading stand structures are more generically known as copy holders and are used for a variety of purposes generally associated with the support and positioning of books or other types of copy material in a manner which is more efficient for viewing when such books are being read. Typically, such prior art reading stands are relatively bulky and/or heavy and generally structured to restrict the efficient carrying or transporting thereof between locations.

While reading stands do exist in the prior art which are generally considered portable and/or at least partially collapsible, the workings and/or structural integrity of the component from which such prior art structures are formed may be considered to be either too complicated or less than reliable from a structural integrity standpoint. The structures of the type referred to as existing in the prior art are generally represented in the following U.S. Pat. Nos.: 756,486; 706,228; 1,203,659; 3,562,796; 4,022,418; and 4,555,128.

Even though prior art structures of the type generally represented in the above-noted patents are known in the prior art, there is still a need in this area for a collapsible reading stand which is specifically structured to be selectively and variably adjustable while at the same time being of durable yet lightweight construction to ensure a long operable life of such a structure. Such a preferred reading stand should have the versatility of supporting books or like objects on an exposed surface of a copy holder in a manner which will allow the adjustment of the angular orientation of the supported book or like object as well as the overall height of the book relative to a supporting surface on which the subject reading stand is mounted. A preferred structure should be capable of providing such variable adjustments relative to the reader or user of the subject reading stand to accomplish an efficient viewing angle. The variety of adjustments possible with such a preferred structure will allow the reader to assume the best posture possible without having to bend or slouch. This, of course, will enable the reader to read or view the book or like copy material for longer periods of time while being able to maintain a physically comfortable position.

SUMMARY OF THE INVENTION

This invention relates to a reading stand having various supporting components which may be selectively positioned into a collapsed or stored position thereby rendering the reading stand portable and allowing it to be carried between locations by the user thereof. More specifically, the reading stand comprises a copy holder having a substantially planar exposed surface on which a book, magazine, or the like is positioned to facilitate viewing or observing by a reader. A base is secured to a lower end of the copy holder and is defined by a substantially L-shaped configuration having a copy holder engaging portion and an outwardly extending support portion on which the lower end of the book being read is positioned.

Another important feature of the present invention is its versatility in that it may be adjusted both as to height of the copy holder and the book thereon relative to any type of supporting surface on which the reading stand is positioned and also to the angular orientation of the copy holder relative to the viewer. Both the height and the angular orientation, as set forth above, are adjustable in order to provide the best possible position of the book or like copy material to the reader. This allows the reader to assume the proper and the most comfortable posture. Comfort to the reader, of course, is important especially when the book is intended to be read or observed for extended periods of time.

A height adjustment means comprises a plurality of extension arms pivotally attached generally to a rear of the reading stand and more specifically to a rear portion of the base thereof. Each of the extension arms are pivotal from a stored position, which facilitates carrying of the reading stand, to an operative position defined by an outward and downward extension of one of the extension arms beyond the base and into resting engagement on any type of supporting surface such as a desk top or the like. Each of the extension arms are of a different length so that the user may regulate the height of the copy holder and the book or other copy material thereon relative to his preferred line of sight and above the supporting surface on which the reading stand rests. A bracing portion is mounted or formed on a substantially rear portion of the base and serves to brace and engage any one of the arms pivotally disposed into the aforementioned operative position. The extension arm in the operative position is, therefore, maintained and properly braced in its downward and outward extension relative to the base.

Another important feature of the present invention is the provision of an angle adjustment means which allows the angular orientation of the copy holder and of course the book or like copy material thereon to be varied to accomplish the maximum or most comfortable viewing angle for the reader. This angle adjustment means comprises a first arm having an inner end pivotally secured to a rear portion of the reading stand and extending outwardly therefrom, when in its operative position, in resting engagement on the supporting surface on which the reading stand rests. The angle adjustment means further comprises a second arm having its inner end also pivotally or otherwise movably attached to the under surface of the copy holder and extending angularly outward therefrom so as to engage and be supported by a plurality of recesses or receiving notches formed continuously along the length of the first arm.

In a preferred embodiment to be described in greater detail hereinafter, the receiving notches extend substantially along the entire length of the first arm and are formed by a substantially continuous sinuous configuration wherein the plurality of receiving notches are disposed in spaced relation to one another. Of course, the angle of orientation of the copy holder is dependent upon the location of the receiving notches along the length of the first arm in which the outer most end of the second arm rests. Such point of location of course can be varied in order to significantly vary the angular orientation of the copy holder relative to the reader or viewer and his line of sight.

Yet another important feature of the present invention is the ability of all of the aforementioned components including the plurality of extension arms as well as the first and second arms of the angle adjustment means to be located into a retracted or stored position generally immediately adjacent to the rear surface of the copy holder and in substantially parallel relation thereto. Locking means in the form of flexible material clips or like structures serve to engage each of the extension arms and first and second arms of the angle adjustment means in order to maintain these components in the aforementioned stored position.

A handle is provided which extends outwardly from one side or end of the copy holder. The handle is extendable outwardly into an operative position such that the entire assembly may be easily carried by the user of the reading stand and thereby transported from location to location.

DESCRIPTION OF THE PRIOR ART

Like reference numerals refer to like parts throughout the several views of the drawings.

DETAILED DESCRIPTION OF THE PREFERRED EMBODIMENT

As shown in the accompanying figures, the present invention is directed to a reading stand generally indicated as 10. The reading stand includes a copy holder 12 having a substantially outer or exposed surface 14 and a rear surface 16. A base generally indicated as 18 is attached to the copy holder 12.

Figures 1, 2, 3, 4, 5, 6:
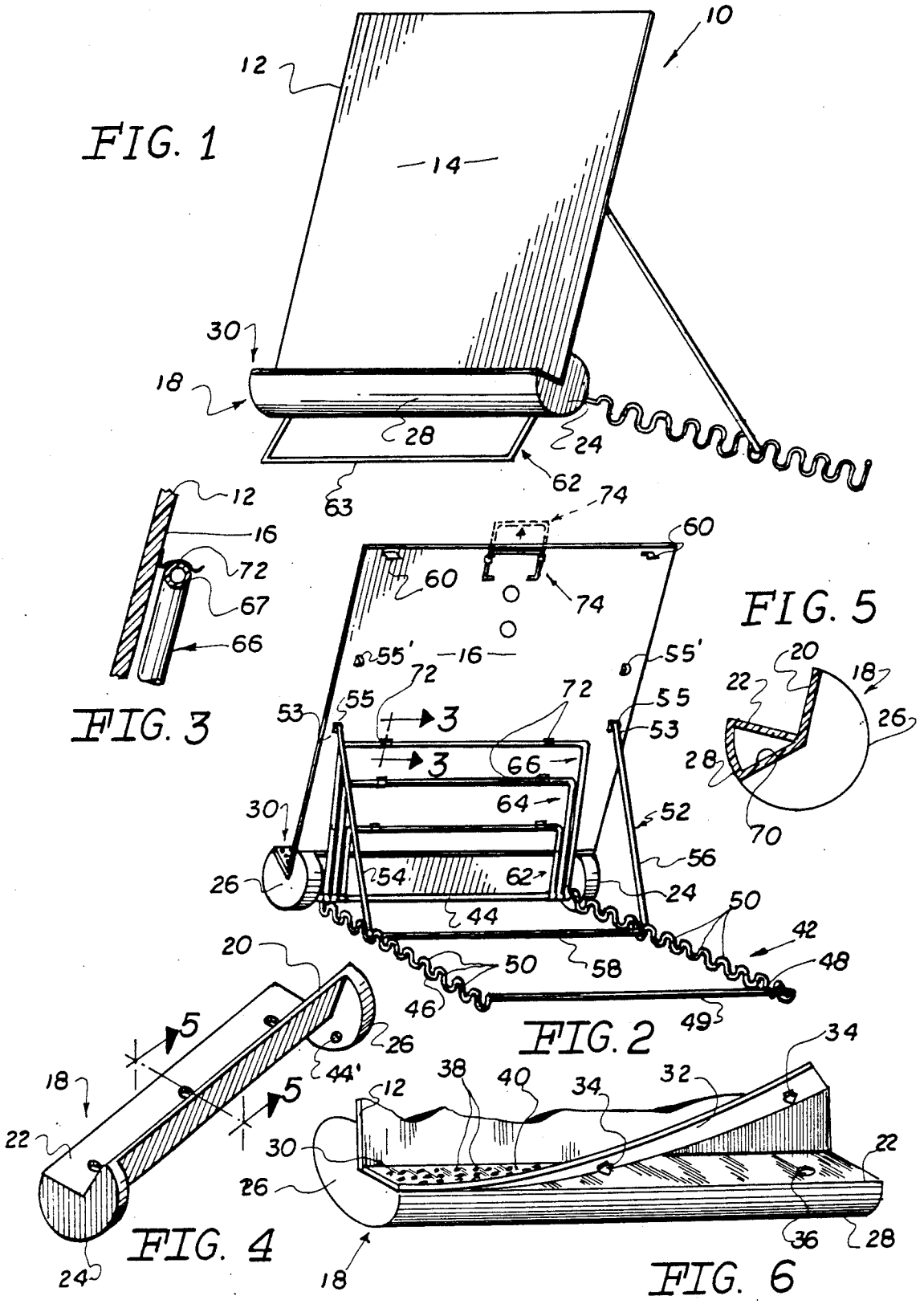
FIG. 1 is a front perspective view of the reading stand of the present invention in a raised position.
FIG. 2 is a rear perspective view of the embodiment of FIG. 1 in a non-raised position.
FIG. 3 is a sectional view and partial cutaway along line 3—3 of FIG. 2.
FIG. 4 is a perspective view of a base portion of the present invention.
FIG. 5 is a sectional view along line 5—5 of FIG. 4.
FIG. 6 is a perspective view in partial cutaway of a retaining pad associated with a support portion of the base of the present invention.

The base 18 includes a copy holder attachment portion 20 and a support portion 22 thereby defining a substantially L-shaped configuration. Opposite ends of the base 18 as at 24 and 26 have a substantially curvilinear or arcuate outer periphery as shown in FIGS. 1, 2, and 4. The base serves to rest on any type of supporting surface such as a desk top, table top, or the like. A front, outer surface 28 of the base 18 also includes a substantially bevelled or curvilinear surface extending along at least the front portion thereof. The base is disposed such that the support portion 22 extends substantially transversely outward from the outer or exposed surface 14 of the copy holder 12 and serves to support a lower end of a book, magazine, or any other like copy material being viewed or read by the user of the stand 10. In order to facilitate retention of the book on the exposed surface 14 of copy holder 12 in a preferred manner and further in order to somewhat restrain the pages of the book from inadvertently turning, a retention means is provided and generally indicated as 30 in FIGS. 1, 2, and 6. The retaining means 30 includes a flexible material pad having an undersurface as at 32 with at least one but preferably a plurality of outwardly projecting fingers 34 secured thereto. The fingers 34 are designed to removably fit within receiving apertures as at 36 formed in the support portion 22 of the base 18. It should be apparent therefore that the retaining pad 30 may be removably disposed in covering relation to the support portion 22 and in actual contact with the lower end of the book or like copy material maintained on the copy holder against the exposed surface 14.

Further, the retaining pad 30 includes a gripping means or assembly for engaging the lower end of the pages of the book. Such gripping assembly includes a plurality of outwardly extending projections as at 38 extending outwardly at least a minimal distance from an outer surface 40 of the retaining pad 30. The projections are disposed and are dimensioned so as to reduce the possibility of the pages of the book or like copy material from inadvertently turning due to the fact that such projections 38 effectively grip or maintain the pages in their desired position.

Another feature of the present invention comprises an angle adjustment means. The angle adjustment means includes a first arm 42 pivotally connected at its inner end to a rod or shaft 44 having its opposite ends secured to the opposite ends 24 and 26 of the base 18 as at 44'. The first arm 42 has two segments 46 and 48 each defined by a sinuous or serpentine configuration along their lengths thereby defining a plurality of receiving notches 50 extending continuously along the length of each segment. The two segments are connected at their outer end by cross member 49. The angle adjustment means further includes a second arm generally indicated as 52 and having its inner end as at 54 pivoted to the under surface 16 of the copy holder 12 by connectors 55 so that it may be selectively disposed into and out of an operative position as basically shown in FIGS. 1 and 2. The second leg 52 also includes two segments 54 and 56 connected by a cross member 58. In its operative position, the outermost end of each of the segments adjacent their junction to the cross member 58 is disposed in appropriate receiving notches 50 along the length of each of the segments 46 and 48. It is obvious that the specific receiving notches 50 in which the outer end of the second leg 56 is disposed determines the angular orientation of the copy holder relative to the view of the reader and his line of sight. A locking means in the form of locking clips 60 are provided to maintain the first arm in a locked position. (See FIGS. 7 and 8). The same locking clips 60 can also be used to removably maintain the outermost and/or cross member 58 of the second arm 52 in the aforementioned collapsed or locked position as also best shown in FIGS. 7 and 8.

Further, with regard to the angle adjustment means, the ends 53 of each of the arm segments 54 and 56 may be removed from their pivotal connection as at 55 and changed to a spaced apart pair of pivotal connectors 55'. This again adds versatility in regulating or changing the angle of orientation of the copy holder relative to the viewer's line of sight. More specifically, the ends 53 of the arm segments 54 and 56 may be pivotally connected to the pair of connectors 55 or to the pair of connectors 55' disposed in spaced relation therefrom on the under surface 16 of the copy holder 12 to obtain a greater versatility in the angular orientation of the copy holder 12.

Another important feature of the present invention is a height adjustment means which is defined by a plurality of extension arms 62, 64 and 66, each similarly shaped into the configuration of the second arm 52 of the angle adjustment means. The innermost ends of each of the extension arms 62, 64, and 66 are pivotally connected to the rod or shafts 44 and therefore selectively removable between the stored position as shown in FIG. 2 or an outwardly extending position as represented by one of the arm 62 in FIG. 1. When in their outwardly extending position, the height of the base is spaced from a supporting surface on which the assembly is positioned and, of course, the height of the copy holder is similarly raised. When in its operative or extended position, the outermost end as at 63 rests directly on the supporting surface as shown. When any of the extension arms 62, 64, and 66 are in the extended position, a portion of its length is braced against a bracing means. Such bracing means is best shown in FIG. 6 and includes an angularly oriented rear surface portion as at 70 of the base which extends along the length thereof.

The arms, as set forth in FIG. 2, may each be stored in a separate collapsed position and maintained in said position by locking means. The locking means are in the form of flexible material clips 72 best shown in FIG. 3 wherein the arms can be readily removed therefrom as should be apparent.

Figure 7:
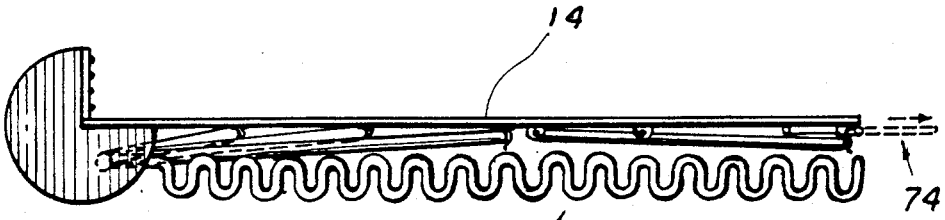
FIG. 7 is a side view of the present invention in a collapsed or stored position.
Figure 9:
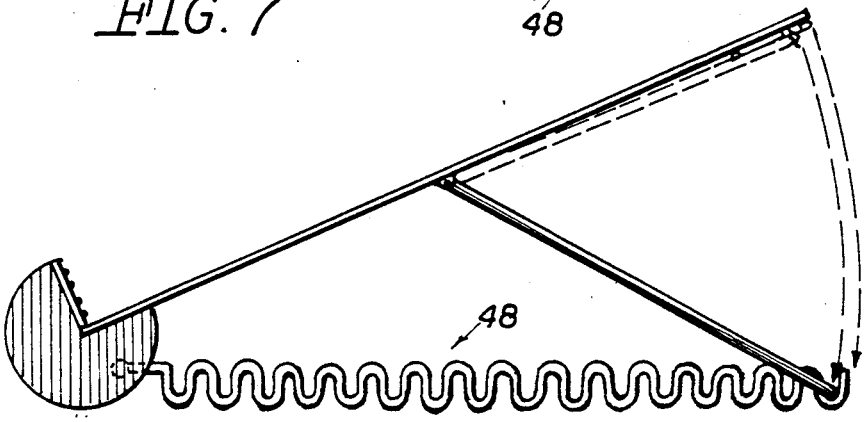
FIG. 9 is a side view of the present invention at one preferred angular orientation.
Figure 8:
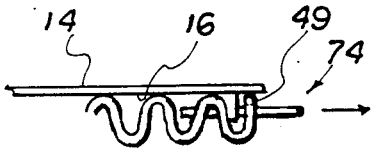
FIG. 8 is a detailed view in partial cutaway of a handle portion of the present invention.
Figure 10:
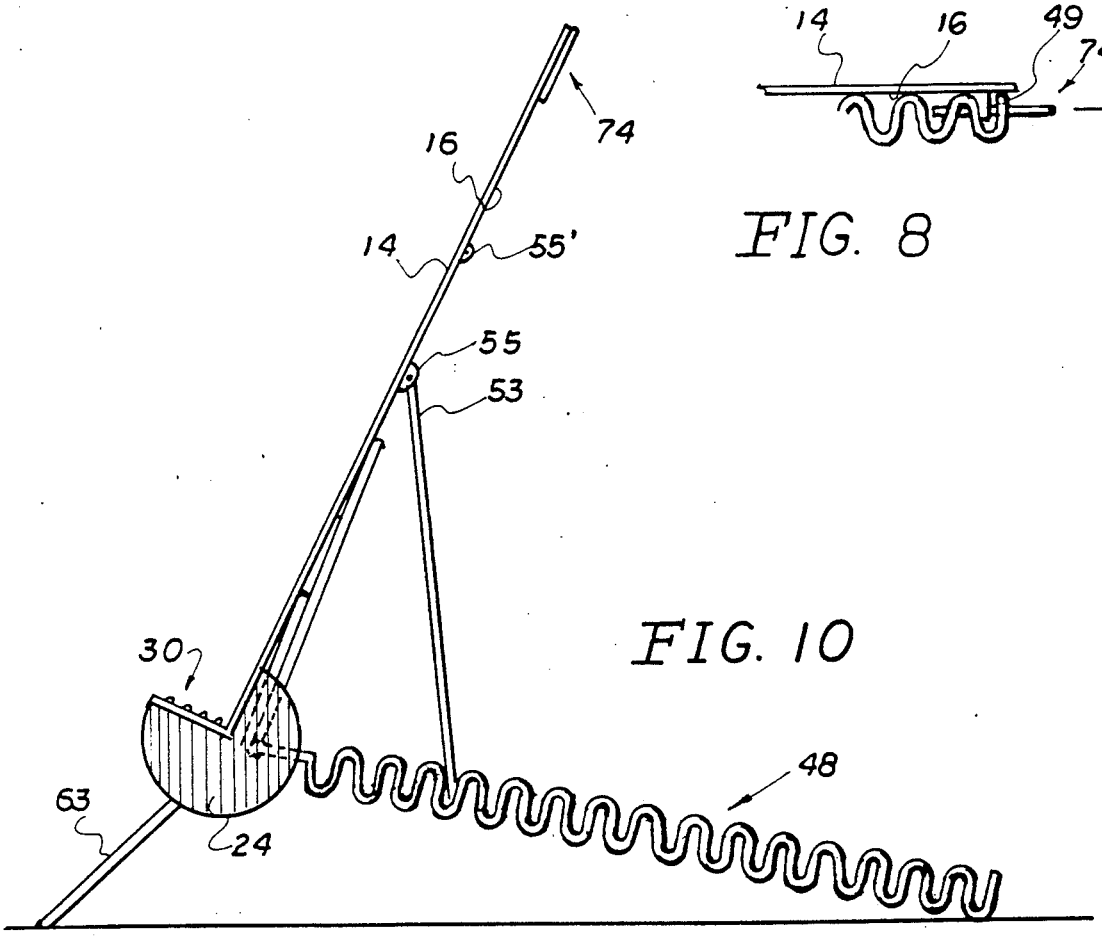
FIG. 10 is a side view of the present invention in a raised position and at a different angular orientation than that of FIG. 9.

Yet another feature of the present invention is the provision of a handle means generally indicated as 74 being slidably mounted on the rear surface and positioned between the collapsed positions shown inside the lines of FIG. 2 and an operative position shown in phantom lines in FIG. 2. With regard to FIG. 8, when the first arm 42 of the adjustment means is in its collapsed position as shown in FIGS. 7 and 8, the cross member 49 cooperates with the handle 74 such that the cross member 49 is prevented from opening as it is sandwiched between the rear surface 16 of the copy holder 12 and the handle 74 when in its extended operative position.

Now that the invention has been described,

What is claimed is:

1. A portable reading stand assembly comprising:

a copy holder having a substantially planar exposed surface and a base attached to a lower end thereof, angle adjustment means movably connected to said copy holder and positionable outwardly therefrom for adjusting orientation of said copy holder relative to a supporting surface on which said base is disposed, said angle adjustment means comprising a first arm including a plurality of receiving notches formed along a length thereof and a second arm movably connected to said copy holder and positionable into supported engagement along the length of said first arm, both said first arm and aid second arm being pivotally attached to said copy holder and movable between said collapsed position and an operative position, said collapsed position defined by a folded, substantially parallel orientation of said first and second arms relative to and adjacent a rear surface of said copy holder, said operative position defined by an outwardly extending orientation of said first arm in supported engagement with the supporting surface and an outer end of said second arm removably mounted in the plurality of receiving notches along the length of said first arm.

height adjustment means including at least one extension arm pivotally mounted to said copy holder and movable so as to extend outwardly from beneath said base and into supported engagement with the supporting surface for adjustment of the height of said copy holder above the supporting surface, said base including a copy support portion disposed at the lower end of the copy holder in outwardly extending relation to said exposed surface thereof and in supporting relation to a copy disposed on said exposed surface, retaining means connected to said support portion for retaining the copy in place thereon and including a flexible material pad having a gripping assembly including a plurality of spaced apart projections extending outwardly from an outer surface thereof and into engagement with a lower edge of the copy, said pad being removably attached in overlying relation to said support portion and including at least one connecting finger extending outwardly from an under surface thereof through receiving apertures formed in said supporting, and handle means movably mounted on the rear surface of the copy holder and selectively disposed between a stored and a carrying position.

2. An assembly as in claim 1 wherein said one extension arm is pivotal into braced engagement with said base and extends outwardly therefrom to define an extended position and selectively into substantially parallel position with said copy holder to define a retracted position.

3. An assembly as in claim 2 wherein said extended position is defined by a raised, spaced disposition of said base above the supporting surface.

4. An assembly as in claim 2 wherein said height adjustment means comprises a plurality of extension arms each of a different length and each independently disposable between said extended position and said retracted position and each extending outwardly from said base a distance different from the remainder of said plurality of extension arms, whereby the height of said copy holder above the supporting surface may vary depending on which of said plurality of extension arms is in said extended position.

5. An assembly as in claim 4 wherein said plurality of extension arms are disposed in substantially co-planar relation adjacent the rear surface of said copy holder when in said retracted position.

6. An assembly as in claim 1 wherein said base further comprises opposite end portions having a curvilinear, exterior support surface extending continuously between said support portion and said copy holder engaging portion exteriorally of an outer surface of said support portion.

7. An assembly as in claim 6 wherein said one extension arm is pivotally attached substantially at a proximal end thereof to said opposite end portions and pivotal between a retracted position and an extended position, said extended position defined by a distal end of said one extension arm engaging the supporting surface. in outwardly spaced relation to said base.

8. An assembly as in claim 1 wherein said base further comprises a bracing portion formed on a rear surface of said base and disposed for abutting, embracing engagement with said one extension arm when in said extended position.

9. An assembly as in claim 1 wherein an outer end of said first arm is disposed in sandwiched relation between said rear surface of said copy holder and said handle when said handle is in carrying position and said first arm is in said collapsed position.

* * * * *